US011282626B2

(12) United States Patent
Kusawake et al.

(10) Patent No.: US 11,282,626 B2
(45) Date of Patent: Mar. 22, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kazushi Kusawake, Mie (JP); Shintaro Nanbara, Mie (JP); Yusaku Maeda, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 399 days.

(21) Appl. No.: 16/488,699

(22) PCT Filed: Feb. 8, 2018

(86) PCT No.: PCT/JP2018/004416
§ 371 (c)(1),
(2) Date: Aug. 26, 2019

(87) PCT Pub. No.: WO2018/159254
PCT Pub. Date: Sep. 7, 2018

(65) Prior Publication Data

US 2021/0202149 A1 Jul. 1, 2021

(30) Foreign Application Priority Data

Feb. 28, 2017 (JP) ..... JP2017-036000

(51) Int. Cl.
*H01F 27/02* (2006.01)
*H01F 27/255* (2006.01)
(Continued)

(52) U.S. Cl.
CPC ..... *H01F 27/255* (2013.01); *H01F 27/28* (2013.01); *H01F 41/12* (2013.01)

(58) Field of Classification Search
USPC .... 336/221, 233, 192, 90, 65, 212, 178, 210
See application file for complete search history.

(56) References Cited

U.S. PATENT DOCUMENTS 3,463,196 A * 8/1969 Richardson ..... F16L 23/02 138/96 R
2012/0092120 A1 4/2012 Yoshikawa et al.
(Continued)

FOREIGN PATENT DOCUMENTS

JP 2012-253289 A 12/2012
JP 2013-004531 A 1/2013
JP 2016-149453 A 8/2016

OTHER PUBLICATIONS

International Search Report, Application No. PCT/JP2018/004416, dated Apr. 24, 2018. ISA/Japan Patent Office.

*Primary Examiner* — Shawki S Ismail
*Assistant Examiner* — Kazi S Hossain
(74) *Attorney, Agent, or Firm* — Honigman LLP

(57) ABSTRACT

A reactor includes a coil; a magnetic core with an inner core portion arranged inside the coil; and an inwardly interposed member insulating the coil from the inner core portion. The inwardly interposed member has a thin portion defined by a recess of an inner-circumferential surface, and a thick portion that is thicker than the thin portion. The inner core portion has, on an outer circumferential surface facing the inwardly interposed member, a core-side projection portion has a shape conforming to the inner-circumferential surface shape of the thin portion. The thin portion has a thickness of 0.2 mm to 1.0 mm inclusive, and the thick portion has a thickness of 1.1 mm to 2.5 mm inclusive. The inner core portion and the inwardly interposed member are in intimate
(Continued)

contact with each other, and the inwardly interposed member and the wound portion are in intimate contact with each other.

9 Claims, 5 Drawing Sheets

(51) Int. Cl.
*H01F 27/28* (2006.01)
*H01F 41/12* (2006.01)

(56) References Cited

U.S. PATENT DOCUMENTS

| | | | | |
|---|---|---|---|---|
| 2012/0126928 | A1 | 5/2012 | Yoshikawa et al. | |
| 2012/0154093 | A1 | 6/2012 | Yoshikawa et al. | |
| 2013/0181801 | A1 | 7/2013 | Yoshikawa et al. | |
| 2014/0125308 | A1 | 5/2014 | Yoshikawa et al. | |
| 2015/0352965 | A1* | 12/2015 | Inaba | H01F 27/02 363/131 |
| 2015/0365015 | A1* | 12/2015 | Ito | H01F 37/00 363/131 |
| 2018/0358172 | A1* | 12/2018 | Yamamoto | H01F 37/00 |

* cited by examiner

REACTOR

CROSS-REFERENCE TO RELATED APPLICATIONS

This application is the U.S. national stage of PCT/JP2018/004416 filed on Feb. 8, 2018, which claims priority of Japanese Patent Application No. JP 2017-036000 filed on Feb. 28, 2017, the contents of which are incorporated herein.

TECHNICAL FIELD

The present disclosure relates to a reactor.

BACKGROUND

For example, JP 2012-253289A and JP 2013-4531A disclose reactors that are magnetic components used in converters for electric-powered vehicles such as hybrid automobiles. The reactors disclosed in JP 2012-253289A and JP 2013-4531A are provided with a coil with a pair of wound portions, a magnetic core partially arranged inside the wound portions, and a bobbin (insulating interposed member) that ensures insulation between the coil and the magnetic core.

SUMMARY

According to the present disclosure, a reactor includes a coil with a wound portion. A magnetic core with an inner core portion is arranged inside the wound portion. An inwardly interposed member is configured to ensure insulation between the wound portion and the inner core portion, wherein the inwardly interposed member has a thin portion that is thin as a result of an inner-circumferential surface of the inwardly interposed member being recessed, and a thick portion that is thicker than the thin portion, the inner core portion has, on an outer circumferential surface that faces the inwardly interposed member, a core-side projection portion that has a shape conforming to the shape of the inner-circumferential surface of the thin portion, the thin portion has a thickness of 0.2 mm to 1.0 mm inclusive, and the thick portion has a thickness of 1.1 mm to 2.5 mm inclusive, and the inner core portion and the inwardly interposed member are in substantially intimate contact with each other, and the inwardly interposed member and the wound portion are in substantially intimate contact with each other.

DETAILED DESCRIPTION OF PREFERRED EMBODIMENTS

Figure 1:
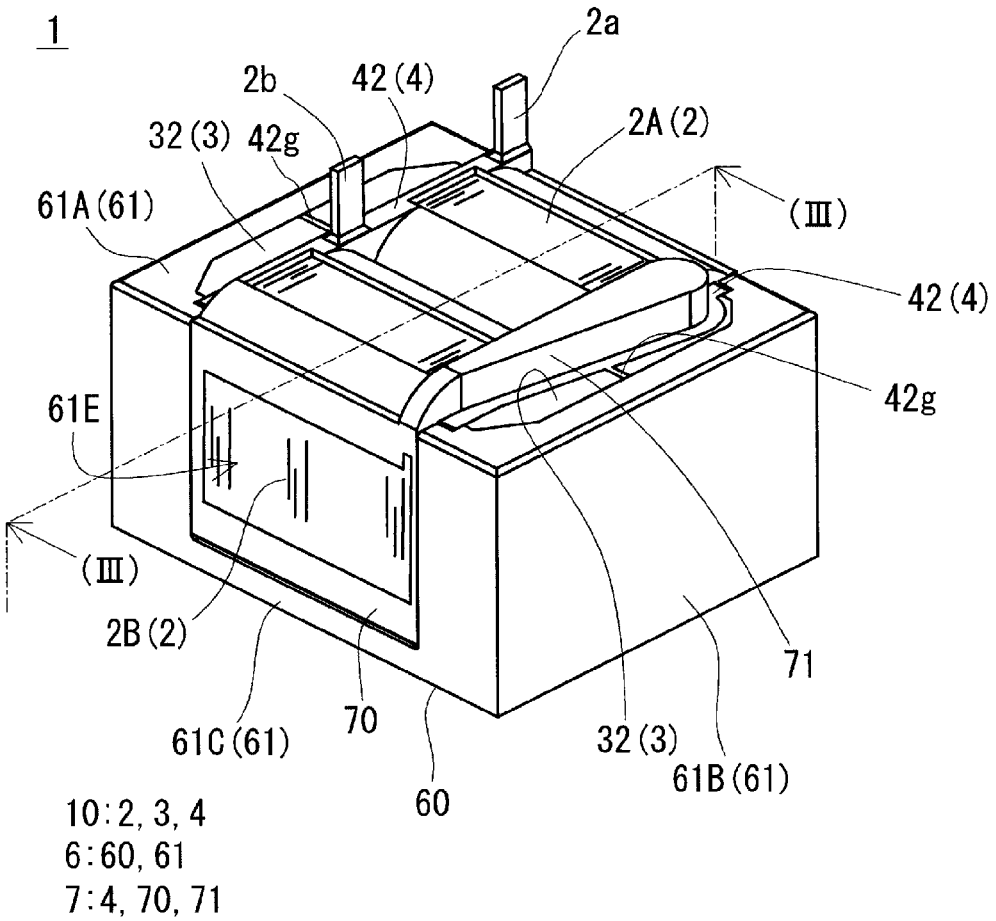
FIG. 1 is a schematic perspective view illustrating a reactor including a coil with a pair of wound portions according to Embodiment 1.

With recent development of electric-powered vehicles, there is a demand for improvement in performance of a reactor. For example, there is a demand for improvement in heat dissipation properties of the reactor, thereby suppressing changes in magnetic characteristics of the reactor that may be caused by heat accumulated in the reactor. There is also a demand for a reactor that is downsized and has improved magnetic characteristics. In order to meet such requirements, reactor configurations are reviewed.

Therefore, it is an object of the present disclosure to provide a reactor that has improved heat dissipation properties. It is also an object of the present disclosure to provide a reactor that is downsized and has improved magnetic characteristics.

First, embodiments of the disclosure according to the present application will be described sequentially.

Inwardly interposed members are often formed using injection molding. If the inwardly interposed members are thin, the size of the injection molded article is likely to vary. Accordingly, it is conventionally proposed to set the thickness of inwardly interposed members to a given value or more (for example, 2.5 mm or more), or provide ribs or the like on inwardly interposed members as disclosed in Patent Documents 1 and 2, so that the inwardly interposed members have high dimensional accuracy. However, in such a configuration, the distance between a wound portion and an inner core portion is large. Therefore, the dissipation of heat from the inner core portion to the wound portion is constrained, and if the wound portion has a given cross-sectional area, the cross-sectional area of the magnetic path of the inner core portion arranged inside the wound portion cannot be increased to the corresponding given value or more. In view of these issues, the applicants of the present application have accomplished the reactor according to the embodiments below.

According to an embodiment, a reactor includes a coil with a wound portion. A magnetic core with an inner core portion is arranged inside the wound portion. An inwardly interposed member is configured to ensure insulation between the wound portion and the inner core portion, wherein the inwardly interposed member has a thin portion that is thin as a result of an inner-circumferential surface of the inwardly interposed member being recessed, and a thick portion that is thicker than the thin portion, the inner core portion has, on an outer circumferential surface that faces the inwardly interposed member, a core-side projection portion that has a shape conforming to the shape of the inner-circumferential surface of the thin portion, the thin portion has a thickness of 0.2 mm to 1.0 mm inclusive, and the thick portion has a thickness of 1.1 mm to 2.5 mm inclusive, and the inner core portion and the inwardly interposed member are in substantially intimate contact with each other, and the inwardly interposed member and the wound portion are in substantially intimate contact with each other.

If the inwardly interposed member is produced using injection molding, in which resin is injected into a mold, the resin injected into a wide space of the mold is to serve as a thick portion, and the resin injected into a narrow space of the mold is to serve as a thin portion. The wide space of the mold functions to let the resin promptly move through all spaces of the mold. Therefore, an inwardly interposed member having a thick portion with a predetermined thickness or more can easily be produced according to the designed size, even if it has a thin portion that is thinner than a conventional one. To bring the inner core portion and the inwardly interposed member, and the inwardly interposed member and the wound portion of the coil into substantially intimate contact with each other, a method such as resin molding or press fitting is used. In either case, as a result of being able to produce the inwardly interposed member according to the designed size, the three components can be brought into substantially intimate contact with each other. Here, if resin molding or press fitting is performed, the interface between the inner core portion and the inwardly interposed member, or the interface between the inwardly interposed member and the wound portion may partially include a detached portion. Therefore, even if a portion of the interfaces is a detached portion, the three components are regarded as being in substantially intimate contact with each other as long as the total area of the detached portions in all of the interfaces is small (for example, not greater than 40% or 20%).

As a result of the inwardly interposed member including a thin portion that is thinner than a conventional one, it is possible to reduce the distance between the inner core portion and the wound portion, and to improve the dissipation of heat from the inner core portion to the wound portion. Moreover, since the inner core portion and the inwardly interposed member, and the inwardly interposed member and the wound portion are in intimate contact with each other, thermal conductivity between the three components is favorable, and the dissipation of heat from the inner core portion to the wound portion can be improved. Specifically, in the reactor of the embodiments, since the core-side projection portion of the inner core portion is arranged in the recess of the thin portion (hereinafter, also referred to as "interposition-side recess portion"), the distance of heat dissipation from the core-side projection portion to the wound portion is short, and as a result, the heat dissipation properties of the reactor can be improved.

Furthermore, as a result of the inwardly interposed member including a thin portion that is thinner than a conventional one, it is possible to increase the cross-sectional area of the magnetic path of the inner core portion arranged inside the wound portion, without increasing the size of the wound portion. Specifically, in the reactor of the embodiments, the core-side projection portion of the inner core portion is arranged in the interposition-side recess portion of the inwardly interposed member, and thus the cross-sectional area of the magnetic path of the inner core portion is large. Therefore, it is possible to increase, without changing the size of the wound portion, the cross-sectional area of the magnetic path of the inner core portion compared to a case of a reactor using a conventional inwardly interposed member that includes no interposition-side recess portion.

Furthermore, the configurations of the embodiments include advantages such as being able to suppress expansion and contraction of the wound portion that may be caused by use of the reactor, using the inwardly interposed member that is in intimate contact with the inner circumference of the wound portion, or being able to suppress magnetostrictive vibration of the inner core portion, using the inwardly interposed member that is in intimate contact with the outer circumference of the inner core portion.

A configuration of the reactor according to the embodiment may be such that the inwardly interposed member is made of resin that is molded inside the wound portion.

When the wound portion is arranged in a mold, and resin is molded inside the wound portion to form the inwardly interposed member, the resin injected into a wide space between the wound portion and the core of the mold that is arranged inside thereof is to serve as a thick portion, and the resin injected into a narrow space of the mold is to serve as a thin portion. By molding the resin on the wound portion to form the inwardly interposed member, it is possible to reliably bring the wound portion and the inwardly interposed member into intimate contact with each other. Furthermore, since the wound portion and the inwardly interposed member can be formed as one piece, it is possible to reduce time and effort required in assembling the wound portion and the inwardly interposed member, thus improving the productivity of the reactor.

A configuration of the reactor according to the embodiment may be such that the inner core portion is made of a composite material that contains soft magnetic powder and resin.

With the above-described configuration, it is possible to reliably bring the inwardly interposed member and the inner core portion into intimate contact with each other. Specifically, if a molded coil in which the inwardly interposed member is formed inside the wound portion using resin molding is used, simply by filling the molded coil with a composite material, it is possible to form the inner core portion inside the molded coil, and thus it is possible to improve the productivity of the reactor.

A configuration of the reactor according to the embodiment may be such that a difference in the thickness between the thin portion and the thick portion is not less than 0.2 mm.

As a result of a difference in the thickness between the thin portion and the thick portion being set to be not less than 0.2 mm, it is possible to reduce variations in size of the inwardly interposed member, while sufficiently ensuring the filling properties of resin into a narrow and small space of the mold that corresponds to the thin portion.

A configuration of the reactor according to the embodiment may be such that the thickness of the thin portion is 0.2 mm to 0.7 mm inclusive, and the thickness of the thick portion is 1.1 mm to 2.0 mm inclusive.

By setting the thickness of the thin portion to be in the above-described range, it is possible to sufficiently reduce the distance between the wound portion and the core-side projection portion of the inner core portion, and improve the heat dissipation properties of the reactor. Furthermore, by setting the thickness of the thick portion to be in the above-described range, it is possible to further reduce variation in size of the inwardly interposed member.

A configuration of the reactor according to the embodiment may be such that a plurality of thick portions and a plurality of thin portions are distributed in the circumferential direction of the inwardly interposed member.

In a mold used to produce the inwardly interposed member having the above-described configuration, resin is likely to move through all spaces of the mold when the resin is injected, and thus it is easy to produce an inwardly interposed member with little variation in size. In other words, the inwardly interposed member having the above-described configuration is an inwardly interposed member with little variation in size, and can improve the heat dissipation properties and the magnetic characteristics of the reactor. Specifically, if narrow spaces and wide spaces are alternately arranged side by side in the circumferential direction of the spaces of the mold into which resin is injected, the resin is more likely to move through all spaces of the mold. With such a mold, it is possible to produce an inwardly interposed member whose thick portions and thin portions are alternately arranged side by side in the circumferential direction of the inwardly interposed member, with dimensional accuracy.

A configuration of the reactor according to the embodiment may be such that at least some of the thick portions reach an end face, in the axial direction of the wound portion, of the inwardly interposed member.

When the inwardly interposed member is produced using injection molding, resin is often injected at a position of the mold at which an end face of the inwardly interposed member is to be formed. In this case, the end face of the inwardly interposed member serves as an entrance for the resin, and thus, if there is a large space that corresponds to the thick portion in the entrance for the resin, the moldability of the inwardly interposed member will be improved. Here, when the inwardly interposed member whose thick portion reaches the end face of the inwardly interposed member is produced, the wide space that corresponds to the thick portion is formed in the entrance for the resin. Therefore, the inwardly interposed member having the above-described configuration has improved moldability, and it is possible to accurately produce the inwardly interposed member even if a thin portion has a reduced thickness.

A configuration of the reactor according to the embodiment may be such that the inwardly interposed member has an outer circumferential surface in a shape that conforms to an inner-circumferential surface of the wound portion.

If the outer circumferential surface of the inwardly interposed member conforms to the inner-circumferential surface shape of the wound portion, there is hardly any gap between the inwardly interposed member and the wound portion, and thus it is easy to reduce the distance between the inner core portion located inside the inwardly interposed member, and the wound portion. As a result, the heat dissipation properties and the magnetic characteristics of the reactor can be improved with ease.

A configuration of the reactor according to the embodiment may be such that the thickness of the inwardly interposed member gradually increases from the thin portion toward the thick portion.

By employing a configuration in which the thickness of the inwardly interposed member gradually increases from the thin portion to the thick portion, it is possible to improve the moldability of the inwardly interposed member. Examples of the configuration in which the thickness gradually increases from the thin portion to the thick portion include an example in which the portion extending from the thin portion to the thick portion is a curved surface or an inclined surface. The reason why the above-described configuration improves the moldability of the inwardly interposed member is that, when the inwardly interposed member is formed using injection molding, resin injected into the portion of the mold in which the thick portion is to be formed is likely to move through toward the portion in which the thin portion is to be formed.

DETAILS OF EMBODIMENTS OF DISCLOSURE

Hereinafter, embodiments of the reactor of the disclosure according to the present application will be described with reference to the drawings. The same reference numerals in the drawings denote a constituent component with the same name. Note that the disclosure according to the present application is not limited to the configurations shown in the embodiments but is defined by the claims, and is intended to encompass all modifications in the scope of the claims and equivalent thereto.

Embodiment 1

Overall Configuration

A reactor 1 shown in FIG. 1 is provided with an assembly 10 in which a coil 2, a magnetic core 3, and an insulating interposed member 4 are assembled. An example of a feature of this reactor 1 can be part (later-described inwardly interposed members 41 shown in FIGS. 2 to 4) of the insulating interposed member 4 that has a different shape from a conventional one. First, the constituent components of the reactor 1 will be described briefly with reference to FIGS. 1 and 2, and then the shape of the inwardly interposed members 41, and the relationship between the inwardly interposed members 41, the magnetic core 3, and wound portions 2A and 2B will be described in detail with reference to FIGS. 3 to 6, the magnetic core 3 and the wound portions 2A and 2B being respectively arranged inside and outside the inwardly interposed members 41.

Coil

The coil 2 of the present embodiment is provided with the pair of wound portions 2A and 2B, which are arranged in parallel to each other, and a coupling portion that couples the two wound portions 2A and 2B. End portions 2*a* and 2*b* of the coil 2 are drawn from the wound portions 2A and 2B, and are connected to not-shown terminal members. An external device such as a power supply that supplies electric power to the coil 2 is connected via the terminal members. The wound portions 2A and 2B of the coil 2 of the present example have substantially square tubular shapes with the same number of turns and the same winding direction, and are arranged in parallel to each other so that the axial directions thereof are in parallel to each other. The wound portions 2A and 2B may also have different numbers of turns or different cross-sections of the winding wires. Furthermore, the coupling portion of the present example is formed by bending a winding wire that connects the wound portions 2A and 2B in a flatwise manner, and is covered by a later-described coupling portion covering portion 71 so as not to be viewed from the outside.

The coil 2 including the wound portions 2A and 2B can be formed by a coated wire, which is a conductor, such as a rectangular wire or round wire made of a conductive material such as copper, aluminum, magnesium, or an alloy thereof provided with, on its outer circumferential surface, an insulating coating made of an insulating material. In the present embodiment, the wound portions 2A and 2B are formed by winding a coated rectangular wire in an edge wise manner, the coated rectangular wire having a conductor made of a copper rectangular wire and an enamel (typically, polyamide-imide) insulating coating.

Figure 2:
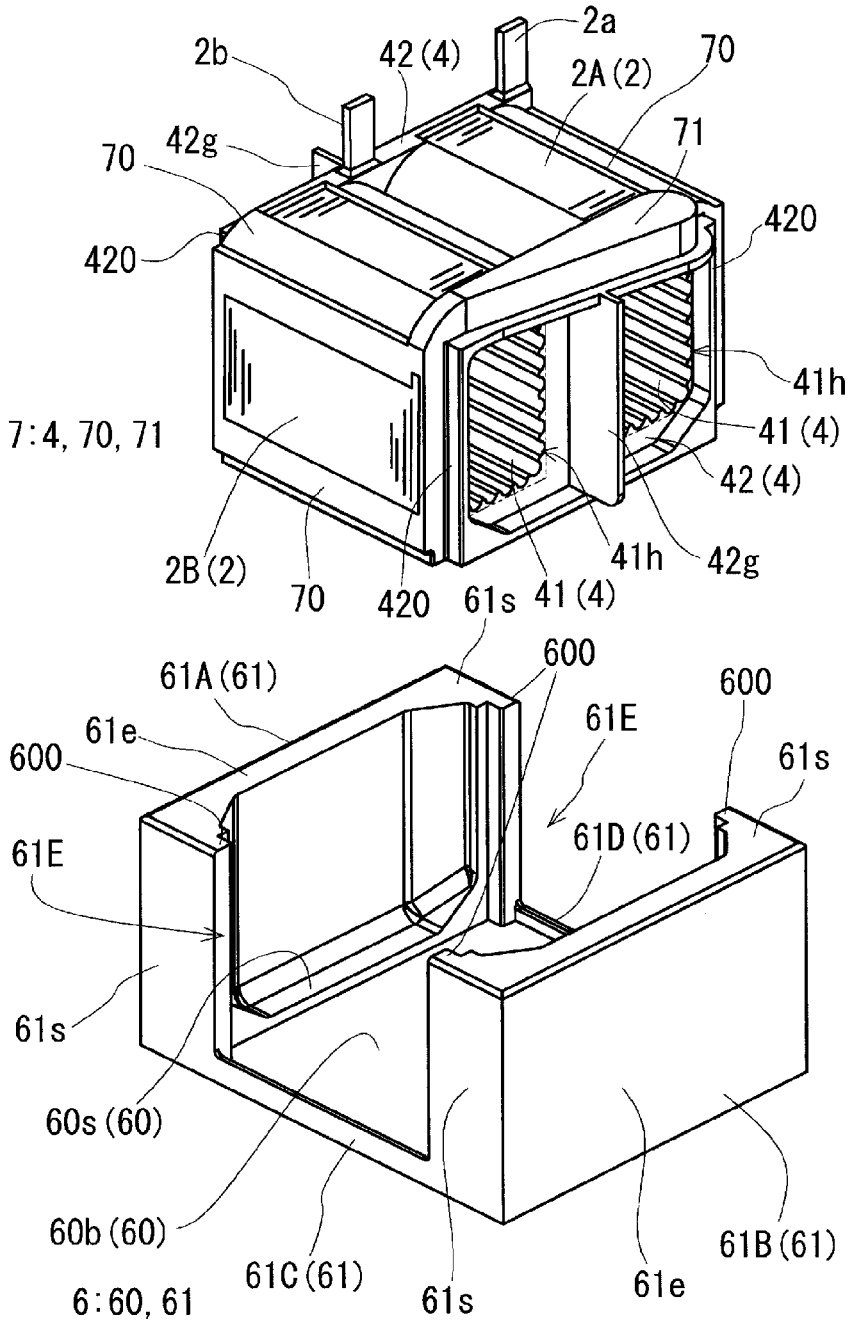
FIG. 2 is an exploded perspective view illustrating an assembly of the reactor according to Embodiment 1.

As shown in FIG. 2, the coil 2 of the present example is used with a coil molded portion 7 that is made of an insulating resin. Part of the coil molded portion 7 functions as the later-described insulating interposed member 4.

Magnetic Core

Figure 3:
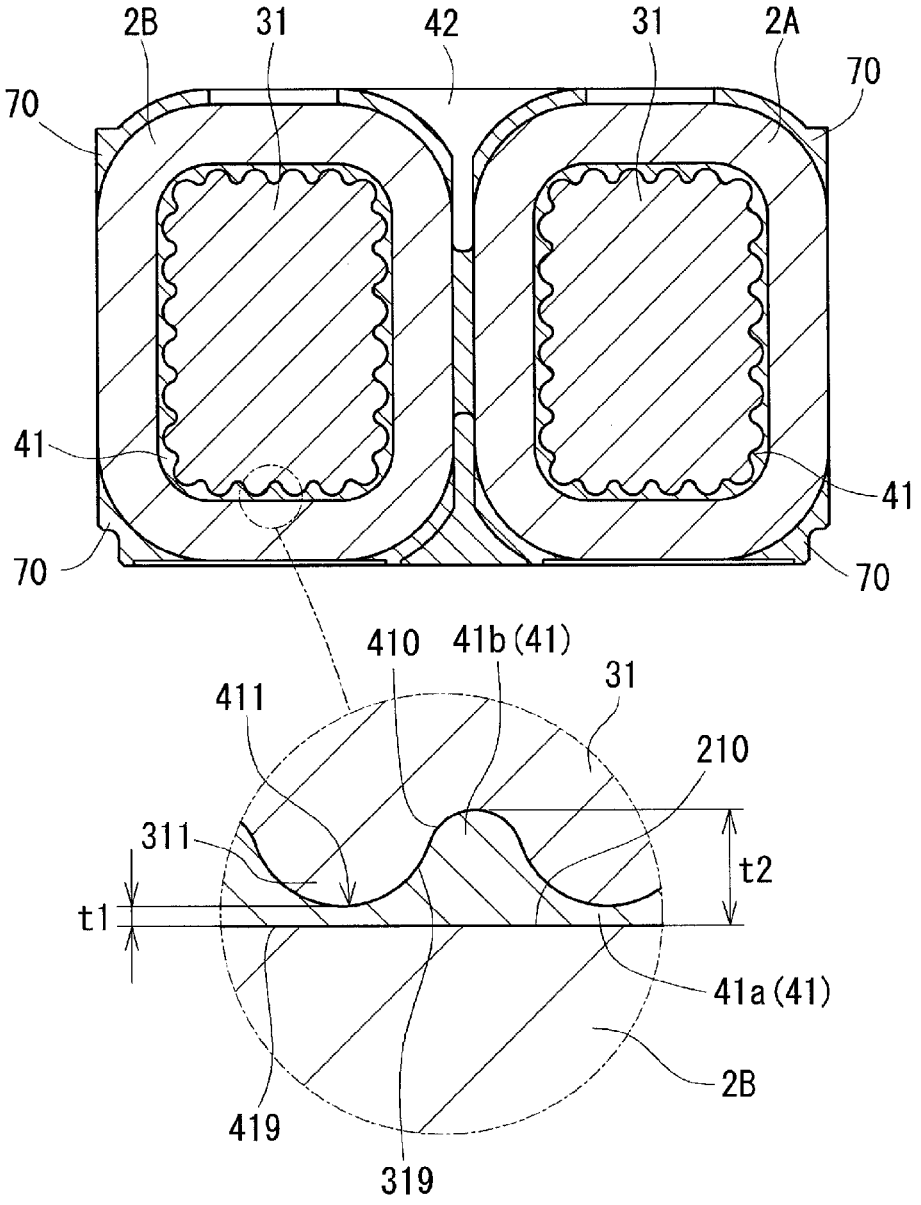
FIG. 3 shows a cross-sectional view taken along a line III-III in FIG. 1 with a partially enlarged view thereof.

The magnetic core 3 can be classified into outer core portions 32 arranged outside the wound portions 2A and 2B (see FIG. 1), and inner core portions 31 arranged inside the wound portions 2A and 2B (see FIG. 3). In the present example, the outer core portions 32 and the inner core portions 31 are coupled into one piece.

Each outer core portion 32 is divided by a gap portion 42*g* in a direction in which the wound portions 2A and 2B are arranged in parallel to each other. The gap portion 42*g* is formed by part of a later-described end-face interposed member 42. Here, the gap portion 42*g* is not limited to a portion that divides an outer core portion 32 into a plurality of core pieces without a coupled portion, and may be any portion as long as it can divide the main portion of a magnetic path of the outer core portion 32. In other words, the gap portions 42*g* do not need to be provided at positions of the outer core portions 32 at which the magnetic path is not affected. For example, even if the gap portions 42*g* have a length in the axial direction of the wound portions 2A and 2B such that they do not reach the end faces of the outer core portions 32, it is sufficient that they are arranged at a position in the magnetic path. Note that, in the configuration of the present example, the gap portions 42*g* are provided, but the gap portions 42*g* are not essential.

The magnetic core 3 is made of a composite material that contains soft magnetic powder and resin. The soft magnetic powder is an aggregation of magnetic grains made of an iron group metal such as iron or an alloy thereof (such as a Fe—Si alloy, a Fe—Si—Al alloy, or a Fe—Ni alloy). The magnetic grains may also have, on their surface, an insulating coating made of phosphoric salt or the like. Furthermore, as the resin, a thermosetting resin such as an epoxy resin, a phenol resin, a silicone resin, or an urethane resin, a thermoplastic resin such as a polyphenylene sulfide (PPS) resin, a polyamide (PA) resin such as nylon 6 or nylon 66, a polyimide resin, or a fluorine resin, or the like may be used, for example. This magnetic core 3 is formed by accommodating the coil 2 in a casing 6, and then filling the casing 6 with the composite material, as illustrated in the later-described manufacturing method of the reactor. Accordingly, the outer core portions 32 of the magnetic core 3 are joined to the inner circumferential surface of the casing 6.

The content of the soft magnetic powder in the composite material may be from 50% by volume to 80% by volume inclusive, out of 100% of the composite material. If the content of the magnetic powder is not less than 50% by volume and the ratio of the magnetic component is thus sufficiently high, it is easy to increase the saturation flux density. If the content of the magnetic powder is not greater than 80% by volume, the composite of the magnetic powder and the resin may have high fluidity, resulting in a composite material with improved moldability. The lower limit of the content of the magnetic powder may not be less than 60% by volume. Furthermore, the upper limit of the content of the magnetic powder may not be greater than 75% by volume, and more specifically not greater than 70% by volume.

Insulating Interposed Member

The insulating interposed member 4 is a member that ensures insulation between the coil 2 and the magnetic core 3. In the present example, the insulating interposed member 4 is formed as part of the coil molded portion 7 obtained by molding resin on the wound portions 2A and 2B. The coil molded portion 7 includes the insulating interposed member 4, turn covering portions 70 that integrate turns into one piece at curved corner positions on the outer circumferential side of the wound portions 2A and 2B, and the coupling portion covering portion 71 that covers the coupling portion (not shown) of the wound portions 2A and 2B.

The insulating interposed member 4, which is formed as the coil molded portion 7, is provided with a pair of inwardly interposed members 41 and a pair of end-face interposed members 42. Each inwardly interposed member 41 is formed inside the wound portion 2A (2B), and is interposed between the inner circumferential surface of the wound portion 2A (2B) and the outer circumferential surface of the inner core portion 31 (FIG. 3). Each end-face interposed member 42 is arranged on one end face (the other end face), in the axial directions of the wound portions 2A and 2B, and is interposed between end faces of the wound portions 2A and 2B and an outer core portion 32.

The internal areas of dashed-two dotted lines (FIG. 2) of the end-face interposed member 42 indicate the inwardly interposed members 41. Accordingly, the end-face interposed member 42 has through holes 41*h* that are open in the inwardly interposed members 41. The openings of the through holes 41*h* serve as entrances via which a composite material, which is to form the inner core portions 31, is inserted into the inwardly interposed members 41. The inner circumferential surfaces of the inwardly interposed members 41 that form the through holes 41*h* have a concave-convex shape. This will be described later with reference to FIGS. 3 and 4.

Each end-face interposed member 42 is frame-shaped while protruding away from the coil 2 in the axial directions of the wound portions 2A and 2B. An outer-side surface (surface in a direction in which the wound portions 2A and 2B are arranged in parallel to each other) 420 of each of the frame-shaped end-face interposed members 42 abuts against edge portions 600 of core opposing portions 61A and 61B of the later-described casing 6.

The end-face interposed members 42 further include a gap portion 42*g* provided between the pair of through holes 41*h*. The gap portion 42*g* is a plate member that protrudes away from the coil 2 in the axial directions of the wound portions 2A and 2B. As has been described, the gap portion 42*g* forms a gap at a position of an outer core portion 32. By adjusting the thickness of the gap portion 42*g*, it is possible to adjust the magnetic characteristics of the magnetic core 3. If adjustment of the magnetic characteristics using the gap portions 42*g* is not needed, the gap portions 42*g* do not need to be provided.

The insulating interposed member 4 having the above-described configuration can be formed of, for example, a thermoplastic resin such as a PPS resin, a polytetrafluoroethylene (PTFE) resin, a liquid crystal polymer (LCP), a PA resin such as nylon 6 or nylon 66, a polybutylene terephthalate (PBT) resin, or an acrylonitrile butadiene styrene (ABS) resin. Alternatively, the insulating interposed member 4 can also be formed of a thermosetting resin such as an unsaturated polyester resin, an epoxy resin, a urethane resin, or a silicone resin. A ceramic filler may also be added to the above-described resin to improve the heat dissipation properties of the insulating interposed member 4. As the ceramic filler, a non-magnetic powder such as alumina or silica may be used, for example.

Casing

As shown in FIG. 2, the casing 6 is constituted by a bottom plate portion 60 and a side wall portion 61. The bottom plate portion 60 and the side wall portion 61 may be formed as one piece, or a bottom plate portion 60 and a side wall portion 61 that are separately prepared may be coupled to each other. As the material of the casing 6, non-magnetic metal such as aluminum, an alloy thereof, magnesium, or an alloy thereof, a resin, or the like may be used, for example. If the bottom plate portion 60 and the side wall portion 61 are separate components, different materials may also be used to form the two portions 60 and 61. For example, non-magnetic metal may be used to form the bottom plate portion 60 and resin may be used to form the side walls, or the reverse may also be applied.

The bottom plate portion 60 is provided with a coil placement portion 60*b* on which the wound portions 2A and 2B are placed, and core contact portions 60*s* that are located on the upper side of the coil placement portion 60*b*, and come into contact with the bottoms of the outer core portions 32 (FIG. 1). The coil placement portion 60*b* is integrated with later-described coupling portions 61C and 61D of the side wall portion 61, and the core contact portions 60*s* are integrated with the later-described core opposing portions 61A and 61B of the side wall portion 61.

The side wall portion 61 is constituted by the pair of core opposing portions 61A and 61B that oppose the outer circumferential surfaces of the outer core portions 32 (FIG. 1), and the pair of coupling portions 61C and 61D that connect these core opposing portions 61A and 61B to each other. The coupling portions 61C and 61D are provided to couple the core opposing portions 61A and 61B to each other to improve the rigidity of the side wall portion 61, and have such a height that they just cover the curved corner portions, on the lower side, of the wound portions 2A and 2B. Accordingly, as shown in FIG. 1, the outer-side surface, in the parallel arrangement direction, of the wound portion 2A, and the outer-side surface, in the parallel arrangement direction, of the wound portion 2B are exposed to the outside of the casing 6. In other words, the side wall portion 61 of the casing 6 of the present example is formed by cutting out the portions that correspond to the outer-side surfaces, in the parallel arrangement direction, of the wound portions 2A and 2B, and the side wall portion 61 has a shape having cut-out portions 61E that expose the outer-side surfaces to the outside of the casing 6.

As shown in FIG. 2, the core opposing portions 61A and 61B are substantially C-shaped when viewed from above. Specifically, the core opposing portions 61A and 61B are each formed by an end-face cover portion 61*e* that covers the end face (on the side opposite to the coil 2) of the outer core portion 32 (FIG. 1) and a pair of side cover portions 61*s* that cover the side faces of the outer core portion 32 being connected to each other in a C shape. The outer surfaces of the side cover portions 61*s* are substantially flush with the outer-side surfaces of the wound portions 2A and 2B. Each side cover portion 61*s* is provided with an edge portion 600, which is formed by reducing the thickness of the side cover portion 61*s* in the vicinity of its edge portion on the coil 2 side. As shown in FIG. 1, the edge portions 600 engage with the outer-side surfaces 420 (FIG. 2) of the end-face interposed members 42, and position the coil 2 in the casing 6. By increasing the length of an overlap between the edge portion 600 and the outer-side surface 420, it is possible to keep, in a later-described reactor manufacturing method, the composite material from leaking from gaps between the end-face interposed members 42 and the core opposing portions 61A and 61B of the side wall portion 61.

Relationship Between Inwardly Interposed Member, Inner Core Portion, and Wound Portion FIG. 3 is a cross-sectional view taken along a line III-III in FIG. 1 that is orthogonal to the axial directions of the wound portions 2A and 2B. In FIG. 3, the illustration of the end portions 2*a* and 2*b* of the coil 2 is omitted. Furthermore, in FIG. 3, the shapes of the constituent components are shown in an exaggerated manner.

As shown in an enlarged view in the circle in FIG. 3, the inwardly interposed member 41 has, on an inner circumferential surface 410 thereof, a plurality of interposition-side recess portions 411. The inwardly interposed member 41 has thin portions 41*a* obtained as a result of the inner-circumferential surface 410 being recessed due to the interposition-side recess portions 411, and thick portions 41*b* that are thicker than the thin portions 41*a*.

Figure 4:
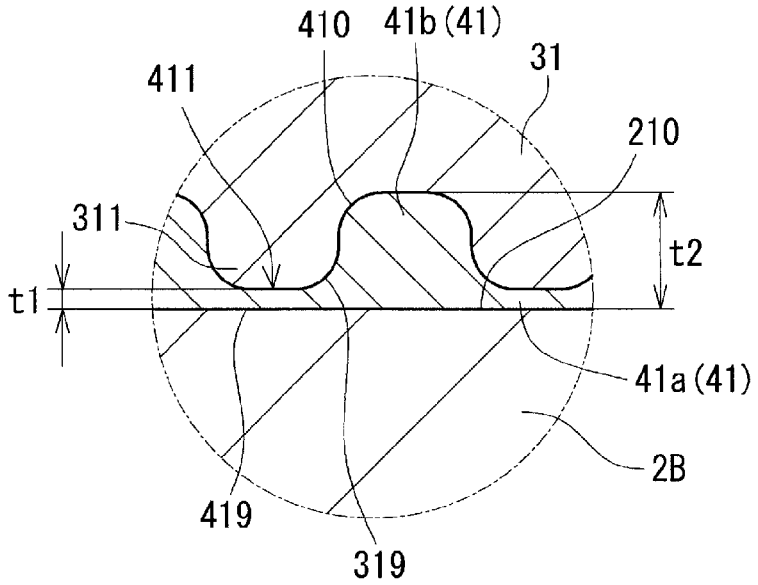
FIG. 4 is a partially enlarged view illustrating the positional relationship between an inwardly interposed member with an interposition-side recess portion that is different from that of FIG. 3, an inner core portion, and a wound portion, the inner core portion and the wound portion being respectively arranged inside and outside the inwardly interposed member.
Figure 5:
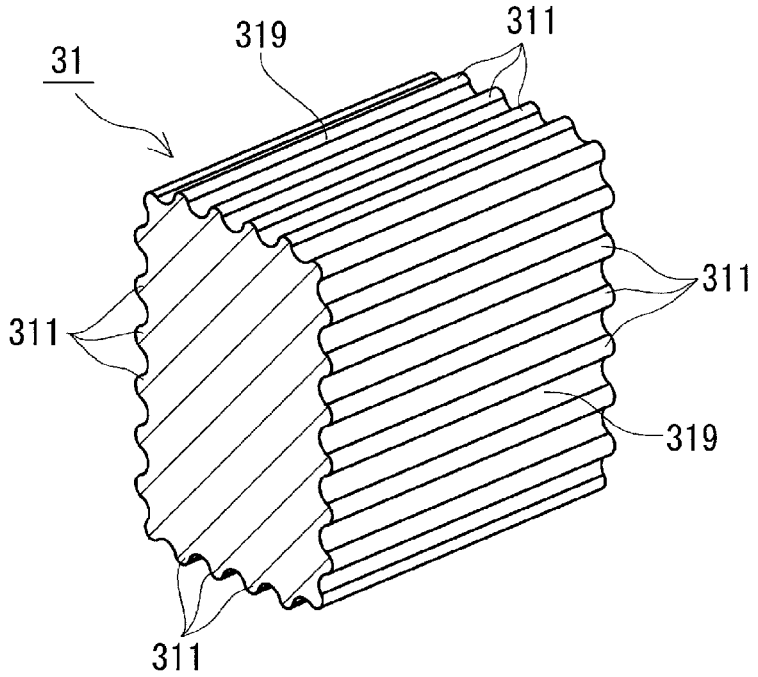
FIG. 5 is a schematic perspective view illustrating the inner core portion according to Embodiment 1.

The shape of the inner-circumferential surfaces of the interposition-side recess portions 411 in a cross section that is orthogonal to a direction in which the interposition-side recess portions 411 extend (that is a direction of depth of the paper of FIG. 3, and is the same as the axial directions of the wound portions 2A and 2B) is not particularly limited. For example, the shape of the inner-circumferential surfaces of the interposition-side recess portions 411 may also be a semi-arc shape as shown in FIG. 3, or a substantially rectangular shape as shown in FIG. 4. Alternatively, the shape of the inner-circumferential surfaces of the interposition-side recess portions 411 may also be a V-groove shape or a dovetail groove shape.

The thin portions 41*a* have a thickness t1 of 0.2 mm to 1.0 mm inclusive, and the thick portions 41*b* have a thickness t2 of 1.1 mm to 2.5 mm inclusive. Here, the thickness t1 of the thin portions 41*a* refers to the thickness of the portions of the interposition-side recess portions 411 that correspond to the deepest position as shown in FIGS. 3 and 4, that is, the smallest thickness of the thin portions 41*a*. The thickness t1 of the thin portions 41*a* is clearly thinner than the thickness (for example, 2.5 mm) of a conventional inwardly interposed member with a uniform thickness. Furthermore, the thickness t2 of the thick portions 41*b* refers to the greatest thickness of the portions in which there is no interposition-side recess portion 411.

If the inwardly interposed members 41 having the above-described configuration are produced inside the wound portions 2A and 2B using injection molding, the resin injected into wide spaces of a mold for use in the injection molding is to serve as the thick portions 41*b*, and the resin injected into narrow spaces of the mold is to serve as the thin portions 41*a*. The wide spaces of the mold function to let the resin promptly move through all spaces of the mold. Therefore, inwardly interposed members 41 having thick portions 41*b* with a predetermined thickness or more can easily be produced according to the designed size even if they have thin portions 41*a* that are thinner than conventional ones, thus making it possible to bring the inwardly interposed members 41 into substantially intimate contact with the inner circumferences of the wound portions 2A and 2B. As a result of the inwardly interposed members 41 having the thin portions 41*a* that are thinner than conventional ones, it is possible to reduce the distance between the inner core portions 31 and the wound portions 2A and 2B, and improve the dissipation of heat from the inner core portions 31 to the wound portions 2A and 2B.

Taking the moldability of the inwardly interposed members 41 into consideration, the plurality of interposition-side recess portions 411 are preferably distributed in the circumferential direction of the inner-circumferential surfaces 410 of the inwardly interposed members 41. In other words, this configuration is such that the plurality of thick portions 41*b* and the plurality of thin portions 41*a* are distributed in the circumferential direction of the inwardly interposed members 41. The mold used to produce the inwardly interposed members 41 is such that a narrow space and a wide space are alternately arranged side by side in the circumferential direction of the spaces of the mold into which resin is injected. With such a mold, when resin is injected, the resin is likely to move through all spaces of the mold, and it is easy to produce inwardly interposed members 41 with little variation in size. Specifically, with the configuration, as in the present example, in which the thin portions 41*a* and the thick portions 41*b* extend in the axial direction of the inwardly interposed member 41, it is easier to fill the mold with resin at the time of molding.

Furthermore, taking the moldability of the inwardly interposed members 41 into consideration, at least some of the thick portions 41*b* preferably reach the end faces, in the axial direction of the wound portions 2A and 2B, of the inwardly interposed members 41. It is preferable that, as shown in FIG. 2, all of the thick portions 41*b* reach the end faces of the inwardly interposed members 41. When an inwardly interposed member 41 is produced using injection molding, resin is often injected at a position of the mold at which an end face of the inwardly interposed member 41 is to be formed. In this case, if the space of the mold that serves as an entrance for the resin is large, the moldability of the inwardly interposed member 41 is improved. In other words, the inwardly interposed member 41 provided with the thick portions 41*b* that reach the end faces of the inwardly interposed member 41 is superior in terms of moldability, and can be accurately produced even if it has the thin portions 41*a* with a small thickness.

On the other hand, the inner core portions 31 that are arranged inside the inwardly interposed members 41 (through holes 41*h*) can be produced by inserting a composite material into the through holes 41*h*. Each of the inner core portions 31 is provided with core-side projection portions 311 formed on the outer circumferential surface thereof (core outer circumferential surface 319) (see FIG. 5 as well). The core-side projection portions 311 have a shape that corresponds to the interposition-side recess portions 411 formed in the inner-circumferential surface 410 of the corresponding inwardly interposed member 41. As described above, the thin portions 41*a* of the inwardly interposed member 41 in which the interposition-side recess portions 411 are respectively formed are thinner than a conventional inwardly interposed member with a uniform thickness. Therefore, the cross section of a magnetic path of an inner core portion 31 that has the core-side projection portions 311 arranged in the interposition-side recess portions 411 is certainly larger than that of a conventional inner core portion by the size of the core-side projection portions 311. Furthermore, the core-side projection portions 311 arranged in the interposition-side recess portions 411 have a smaller distance to the wound portions 2A and 2B than any other portion, and thus heat can be easily dissipated from the core-side projection portions 311 to the wound portions 2A and 2B.

An outer circumferential surface 419 of the inwardly interposed member 41 preferably has a shape that conforms to the shape of the inner-circumferential surface of the wound portions 2A and 2B. With this, there is hardly any gap between the inwardly interposed member 41 and the wound portions 2A and 2B, and it is thus possible to reduce the distance between the inner core portions 31 to the wound portions 2A and 2B. As a result, it is possible to improve the dissipation of heat from the inner core portions 31 to the wound portions 2A and 2B, and to ensure a large cross section of the magnetic path of the inner core portion 31.

More Preferable Configuration

Taking the wide spaces of the mold that correspond to the thick portions 41*b* realizing favorable moldability of the inwardly interposed members 41 into consideration, a difference between the thickness t1 of the thin portions 41*a* and the thickness t2 of the thick portions 41*b* (thickness t2−thickness t1) is preferably set to be not less than 0.2 mm. If specific numerical values are to be defined for the thin portions 41*a* and the thick portions 41*b*, the thickness t1 of the thin portions 41*a* is preferably 0.2 mm to 0.7 mm inclusive, and the thickness t2 of the thick portions 41*b* is preferably 1.1 mm to 2.0 mm inclusive. The thickness t1 of the thin portions 41*a* is more preferably 0.2 mm to 0.5 mm inclusive, and the thickness t2 of the thick portions 41*b* is more preferably 1.1 mm to 2.0 mm inclusive.

By employing a configuration in which the thickness of the inwardly interposed members 41 gradually increases from a thin portion 41*a* toward a thick portion 41*b*, it is possible to improve the moldability of the inwardly interposed member 41. This is because, when the inwardly interposed member 41 is molded using injection molding, resin injected into the portion of the mold in which the thick portions 41*b* are to be formed easily enters the portion in which the thin portions 41*a* are to be formed. As a specific example of this configuration, as shown in, for example, FIGS. 3 and 4, width-directional edge portions (edge portions in the direction in which thick portions 41*b* are present) of a thin portion 41*a* may have a shape such that they are rounded and recessed toward the outside of the inwardly interposed member 41. Furthermore, it is also preferable that width-directional edge portions (edge portions in the direction in which thin portions 41*a* are present) of a thick portion 41*b* have a shape such that they are rounded and protrude toward the outside of the inwardly interposed member 41. The width directional edge portions may be arc-shaped, and in this case, the radius of curvature of the arc may be 0.05 mm to 20 mm inclusive, and more preferably 0.1 mm to 10 mm inclusive. If the arc has a large radius of curvature, as shown in FIG. 3, a width-directional edge portion of a thin portion 41*a* and a width-directional edge portion of a thick portion 41*b* appear to be connected to each other, and the inner-circumferential surface 410 of the inwardly interposed member 41 is wave-shaped. If the arc has a small radius of curvature, as shown in FIG. 4, the inner-circumferential surface 410 of the inwardly interposed member 41 has a shape such that interposition-side recess portions 411 in the shape of rounded rectangular grooves are arranged side by side. Alternatively, the inner-circumferential surface 410 may also have a shape such that interposition-side recess portions 411 in the shape of round V-shaped grooves are arranged side by side.

Reactor Manufacturing Method

To manufacture the reactor 1 of Embodiment 1, the coil 2 with the coil molded portion 7, and the casing 6 are prepared, as shown in FIG. 2. Then, the coil 2 is inserted into the casing 6 (arranging step).

By inserting the coil 2 into the casing 6, a space is formed between the inner-circumferential surface of the core opposing portion 61A (61B) and the end-face interposed member 42. This space is filled with a composite material from above (filling step). The composite material filling up the casing 6 from the space accumulates in the space between the core opposing portion 61A (61B) and the end-face interposed member 42 to form the outer core portion 32 (FIG. 1), and enters the wound portions 2A and 2B via the through holes 41*h* to form the inner core portions 31 (FIG. 3). Here, since the edge portions 600 formed in the thinned portions of the core opposing portion 61A (61B) cover the outer-side surfaces 420 of the end-face interposed member 42, the composite material is kept from leaking to the outside of the casing 6 from the position of the outer-side surfaces 420 of the end-face interposed member 42.

With the above-described manufacturing method, simply by arranging the coil 2 in the casing 6, and filling the casing 6 with a composite material, the reactor 1 can be produced. Therefore, it is possible to improve the productivity of the reactor 1. Furthermore, by forming gap portions 42*g* for adjusting the magnetic characteristics of the magnetic core 3 on the end-face interposed members 42, which are part of the coil molded portion 7, it is possible to reduce time and effort for preparing separate gap materials, and arranging the separate gap materials.

Modification 1-1

In Embodiment 1, the thick portions 41*b* are a series of projections that extend from one end face to the other end face in the axial directions of the wound portions 2A and 2B. Alternatively, thick portions 41*b* that reach one end face of the wound portions 2A and 2B and thick portions 41*b* that reach the other end face of the wound portions 2A and 2B are displaced relative to each other in the circumferential direction of the inwardly interposed members 41. Also, in this case, when the inwardly interposed members 41 are formed inside the wound portions 2A and 2B, and resin is injected from both end face sides of the wound portions 2A and 2B, the entrance for the resin is wide, and thus the inwardly interposed members 41 can be produced with dimensional accuracy.

Figure 6:
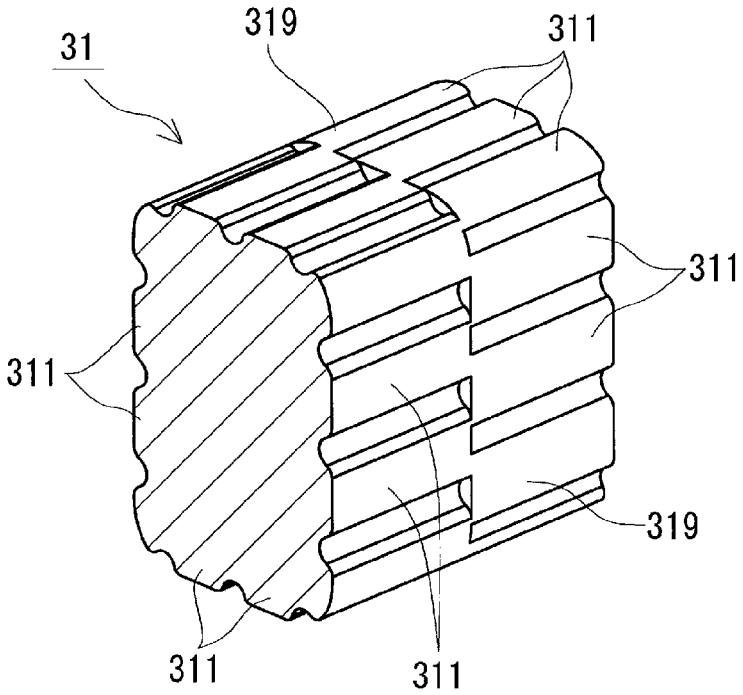
FIG. 6 is a schematic perspective view illustrating an inner core portion according to Modification 1-1.

By inserting a composite material into the inwardly interposed members 41 to produce an inner core portion 31, the inner core portion 31 as shown in FIG. 6 is formed. The inner core portion 31 shown in FIG. 6 has a configuration in which core-side projection portions 311 on one end side, in the axial direction of the inner core portion 31, and core-side projection portions 311 on the other end side, are displaced with respect to each other in the circumferential direction of the inner core portion 31. The core-side projection portions 311 are made of the composite material inserted into the thin portions 41*a* of the inwardly interposed member 41.

Modification 1-2

The divided state of the magnetic core 3 is not limited to the example of Embodiment 1. For example, an assembly is produced by filling the coil 2 with the coil molded portion 7 with a composite material to form the inner core portions 31 inside the inwardly interposed members 41. Then, the assembly may be combined with outer core portions 32 prepared separately from the assembly, and the reactor 1 may be completed. In this case, the outer core portions 32 may also be molded articles of the composite material, or compressed powder molded articles obtained by compressing and molding soft magnetic powder.

Modification 1-3

The casing 6 of Embodiment 1 is not essential. For example, the coil 2 with the coil molded portion 7 is arranged in the mold, and the mold is filled with a composite material for forming the magnetic core 3. Then, when the resin of the composite material is cured, the assembly 10 may be taken out from the mold, and the reactor 1 may be realized.

Embodiment 2

Embodiment 1 described a configuration in which the coil 2 is provided with the pair of wound portions 2A and 2B. Alternatively, the same configuration as in Embodiment 1 may be applied to a reactor that includes a coil provided with a single wound portion.

If a coil provided with a single wound portion is used, resin is molded on the coil, and a molded coil assembly is produced that is provided with an inwardly interposed member and an end-face interposed member that are integrated with the coil. Similar to Embodiment 1, the inwardly interposed member is obtained by molding resin so that it has thin portions and thick portions. This molded coil assembly is arranged in the casing, and the casing is filled with a composite material. In this case, of the composite material filling up the casing, the resin that is inserted into the inwardly interposed member serves as an inner core portion, and the resin that moves to the outside of the wound portion serves as an outer core portion.

Usage

The reactor according to the embodiments is applicable to a power conversion device such as a bidirectional DC/DC converter installed in an electric-powered vehicle such as a hybrid automobile, an electric automobile, or a fuel-cell-powered automobile.

The invention claimed is:

1. A reactor comprising:

a coil with a wound portion;

a magnetic core with an inner core portion arranged inside the wound portion; and an inwardly interposed member configured to ensure insulation between the wound portion and the inner core portion, wherein the inwardly interposed member has a thin portion that is thin as a result of an inner-circumferential surface of the inwardly interposed member being recessed, and a thick portion that is thicker than the thin portion, the inner core portion has, on an outer circumferential surface that faces the inwardly interposed member, a core-side projection portion that has a shape conforming to the shape of the inner-circumferential surface of the thin portion, the thin portion has a thickness of 0.2 mm to 1.0 mm inclusive, and the thick portion has a thickness of 1.1 mm to 2.5 mm inclusive, and the inner core portion and the inwardly interposed member are in substantially intimate contact with each other, and the inwardly interposed member and the wound portion are in substantially intimate contact with each other.

2. The reactor according to claim 1, wherein the inwardly interposed member is made of resin that is molded inside the wound portion.

3. The reactor according to claim 1, wherein the inner core portion is made of a composite material that contains soft magnetic powder and resin.

4. The reactor according to claim 1, wherein a difference in the thickness between the thin portion and the thick portion is not less than 0.2 mm.

5. The reactor according to claim 1, wherein the thickness of the thin portion is 0.2 mm to 0.7 mm inclusive, and the thickness of the thick portion is 1.1 mm to 2.0 mm inclusive.

6. The reactor according to claim 1, wherein a plurality of thick portions and a plurality of thin portions are distributed in the circumferential direction of the inwardly interposed member.

7. The reactor according to claim 1, wherein at least some of the thick portions reach an end face, in the axial direction of the wound portion, of the inwardly interposed member.

8. The reactor according to claim 1, wherein the inwardly interposed member has an outer circumferential surface in a shape that conforms to an inner-circumferential surface of the wound portion.

9. The reactor according to claim 1, wherein the thickness of the inwardly interposed member gradually increases from the thin portion toward the thick portion.

* * * * *